US011247358B2

(12) United States Patent
Hashimoto

(10) Patent No.: US 11,247,358 B2
(45) Date of Patent: Feb. 15, 2022

(54) PIVOTAL NECK RAZOR

(71) Applicant: KAI R&D CENTER CO., LTD., Seki (JP)

(72) Inventor: Kengo Hashimoto, Seki (JP)

(73) Assignee: KAI R&D CENTER CO., LTD., Seki (JP)

( * ) Notice: Subject to any disclaimer, the term of this patent is extended or adjusted under 35 U.S.C. 154(b) by 0 days.

(21) Appl. No.: 16/632,612

(22) PCT Filed: Jul. 24, 2018

(86) PCT No.: PCT/JP2018/027611
§ 371 (c)(1),
(2) Date: Jan. 21, 2020

(87) PCT Pub. No.: WO2019/022043
PCT Pub. Date: Jan. 31, 2019

(65) Prior Publication Data

US 2020/0164536 A1 May 28, 2020

(30) Foreign Application Priority Data

Jul. 24, 2017 (JP) ..... JP2017-142761

(51) Int. Cl.
*B26B 21/22* (2006.01)
*B26B 21/52* (2006.01)

(52) U.S. Cl.
CPC ..... *B26B 21/521* (2013.01); *B26B 21/225* (2013.01)

(58) Field of Classification Search
CPC ..... B26B 21/521; B26B 21/225; B26B 21/30
(Continued)

(56) References Cited

U.S. PATENT DOCUMENTS 1,455,751 A * 5/1923 Hartman ..... B26B 21/52 30/529
4,152,828 A * 5/1979 Lund ..... B26B 21/225 30/529

(Continued)

FOREIGN PATENT DOCUMENTS

CN 106163748 B 3/2020
EP 1046472 A1 10/2000

(Continued)

OTHER PUBLICATIONS

US 5,815,924 A, 10/1998, Apprille, Jr. et al. (withdrawn)

(Continued)

*Primary Examiner* — Kenneth E Peterson
*Assistant Examiner* — Liang Dong
(74) *Attorney, Agent, or Firm* — Tarolli, Sundheim, Covell & Tummino LLP

(57) ABSTRACT

A pivotal neck type razor includes a holder having a top end, and a razor head attached to the holder. The razor head includes a blade assembly, an elastic support body, and a connection unit that is continuous with the top end of the holder. The elastic support body includes a support portion that supports the blade assembly and a flexible portion located between the support portion and the connection unit. The blade assembly is urged by the flexible portion of the elastic support body to be stationary at a neutral position. The blade assembly is movable to at least one movement position from the neutral position against an urging force of the flexible portion.

10 Claims, 8 Drawing Sheets

(58) Field of Classification Search
USPC ..... 30/528, 531, 534, 47–51
See application file for complete search history.

(56) References Cited

U.S. PATENT DOCUMENTS

| | | | | |
|---|---|---|---|---|
| 5,029,391 | A * | 7/1991 | Althaus | B26B 21/225 30/533 |
| 5,038,472 | A | 8/1991 | Iderosa | |
| 5,050,301 | A * | 9/1991 | Apprille, Jr. | B26B 21/225 30/529 |
| 5,784,790 | A | 7/1998 | Carson, III et al. | |
| 5,787,586 | A | 8/1998 | Apprille, Jr. et al. | |
| 5,794,354 | A | 8/1998 | Gilder | |
| 5,813,293 | A | 9/1998 | Apprille et al. | |
| 5,822,869 | A | 10/1998 | Cabo et al. | |
| 5,855,071 | A | 1/1999 | Apprille, Jr. et al. | |
| 5,890,296 | A | 4/1999 | Metcalf et al. | |
| 5,918,369 | A | 7/1999 | Apprille, Jr. et al. | |
| 5,953,825 | A | 9/1999 | Christman et al. | |
| 5,956,851 | A | 9/1999 | Apprille, Jr. et al. | |
| 6,029,354 | A | 2/2000 | Apprille, Jr. et al. | |
| 6,041,926 | A | 3/2000 | Petricca et al. | |
| 6,052,903 | A | 4/2000 | Metcalf et al. | |
| 6,085,426 | A | 7/2000 | Metcalf et al. | |
| 6,138,361 | A | 10/2000 | Paul et al. | |
| 6,192,586 | B1 | 2/2001 | Metcalf et al. | |
| 6,237,232 | B1 | 5/2001 | Petricca et al. | |
| 6,311,400 | B1 | 11/2001 | Hawes et al. | |
| 6,381,857 | B1 * | 5/2002 | Oldroyd | B26B 21/225 30/526 |
| 6,854,188 | B1 * | 2/2005 | Wonderley | B26B 21/225 30/527 |
| 7,461,456 | B2 * | 12/2008 | Tsushio | B26B 19/048 30/43.92 |
| 9,486,930 | B2 | 11/2016 | Provost et al. | |
| 9,616,584 | B2 * | 4/2017 | Coresh | B29C 45/0005 |
| 2003/0213130 | A1 | 11/2003 | Motta | |
| 2004/0177519 | A1 | 9/2004 | Tomassetti et al. | |
| 2005/0000100 | A1 * | 1/2005 | Coffin | B26B 21/28 30/531 |
| 2010/0043242 | A1 | 2/2010 | Stevens | |
| 2012/0073149 | A1 | 3/2012 | Murgida et al. | |
| 2014/0096402 | A1 | 4/2014 | Hiroyuki et al. | |
| 2015/0290822 | A1 | 10/2015 | Haba | |
| 2017/0173806 | A1 * | 6/2017 | Lee | B26B 21/225 |

FOREIGN PATENT DOCUMENTS

| | | | |
|---|---|---|---|
| EP | 2918383 | A1 | 9/2015 |
| JP | H0422388 | A | 1/1992 |
| JP | 2858935 | B2 | 2/1999 |
| JP | 2000300870 | A | 10/2000 |
| JP | 2001510720 | A | 8/2001 |
| JP | 3980060 | B2 | 9/2007 |
| JP | 4166279 | B2 | 10/2008 |
| JP | 5384642 | B2 | 1/2014 |
| JP | 5657803 | B2 | 1/2015 |
| JP | 58/60707 | B2 | 2/2016 |
| WO | 2014073500 | A1 | 5/2014 |

OTHER PUBLICATIONS

Chinese Office Action for Application No. 201880048770.X dated Feb. 1, 2021.
European Search Report for Application No. 18837518.2-1004/3659761 PCT/JP2018027611 dated Mar. 26, 2021.

* cited by examiner

PIVOTAL NECK RAZOR

RELATED APPLICATIONS

The present invention is a U.S. National Stage under 35 USC 371 patent application, claiming priority to Serial No. PCT/JP2018/027611, filed on 24 Jul. 2018; which claims priority of JP 2017-142761, filed on 24 Jul. 2017, the entirety of both of which are incorporated herein by reference.

BACKGROUND OF THE INVENTION

The present invention relates to a pivotal neck type razor allowing a razor head including a blade body to move relative to a top end of a holder against an elastic force.

Patent Document 1 describes a known safety razor. The safety razor of Patent Document 1 includes a handle, a replaceable blade unit accommodating blade bodies, and a joint located between the handle and the replaceable blade unit. The handle includes a pivot shaft that pivotally supports the joint and an elastic member that urges the joint toward a neutral position of the joint. The joint includes two journal shafts that support the replaceable blade unit. The replaceable blade unit includes two journal bearings arranged in correspondence with the two journal shafts of the joint and an elastic piece that urges the replaceable blade unit toward a neutral position of the replaceable blade unit. The two journal shafts of the joint are received by the two journal bearings of the replaceable blade unit so that the joint pivotally supports the replaceable blade unit about the two journal shafts. More specifically, the replaceable blade unit is pivoted about the two journal shafts against an elastic force of the elastic piece from the neutral position of the replaceable blade unit, which is set as the reference. Further, the joint that supports the replaceable blade unit is pivoted together with the replaceable blade unit about the pivot shaft against an elastic force of the elastic member from the neutral position of the joint, which is set as the reference.

PRIOR ART DOCUMENTS

Patent Documents

Patent Document 1: Japanese Laid-Open Patent Publication No. 4-22388

SUMMARY OF THE INVENTION

The safety razor of Patent Document 1 requires separate pivotal support structures for the pivoting direction about the journal shafts and for the pivoting direction about the pivot shaft. Thus, the structure of the razor is complicated.

It is an objective of the present invention to provide a pivotal neck type razor including a holder that has a top end and a razor head that has a blade body and to simplify a support structure that supports the razor head on the top end of the holder so that the razor head moves relative to the top end of the holder from a neutral position against an elastic force.

A pivotal neck type razor according to one aspect of the present invention includes a holder including a top end and a razor head attached to the holder. The razor head includes an elastic support body, a connection unit that is continuous with the top end of the holder, and a blade assembly that includes a blade body. The blade assembly includes a front side from which a blade edge of the blade body is exposed and a rear side that is opposite to the front side. The elastic support body is located at the rear side. The elastic support body includes a support portion that supports the blade assembly and a flexible portion located between the support portion and the connection unit. The blade assembly is urged by the flexible portion of the elastic support body to be stationary at a neutral position. The blade assembly is movable to at least one movement position from the neutral position against an urging force of the flexible portion.

With this configuration, the blade assembly of the razor head attached to the holder is supported by the flexible portion. This simplifies the support structure that movably supports the blade assembly relative to the neutral position against an urging force of the flexible portion. Further, the flexible portion is arranged on the rear side of the blade assembly so that the flexible portion can easily be arranged at a location relatively close to the blade body. This allows for smooth movement of the blade assembly on the skin surface and improves the feel on the skin surface when the pivotal neck type razor is used.

In the pivotal neck type razor, the connection unit and the blade assembly may each include a fulcrum portion that supports the blade assembly on the connection unit.

With this configuration, when the blade assembly of the pivotal neck type razor during usage is moved against an urging force of the flexible portion, the blade assembly is supported by the fulcrum portions. This stabilizes the movement of the blade assembly. For example, when the fulcrum portions are in abutment with each other at the neutral position and the movement position of the blade assembly, the blade assembly is supported by the abutment of the fulcrum portions at the neutral position and the movement position. This stabilizes the movement of the blade assembly relative to the connection unit between the neutral position and the movement position.

In the pivotal neck type razor, the support portion may be one of two support portions that support the blade assembly, the flexible portion may be one of two flexible portions, one of the two flexible portions may be arranged between one of the two support portions and the connection unit, and the other one of the two flexible portions may be arranged between the other one of the two support portions and the connection unit.

With this configuration, the flexible portions are arranged between the support portions and the connection unit in a stable manner.

In the pivotal neck type razor, the blade edge may extend in a direction corresponding to a right-left direction, and the two flexible portions may be arranged at two sides of the connection unit in the right-left direction.

With this configuration, the dimensions of the razor head are decreased in a front-rear direction so that the razor head is reduced in size.

In the pivotal neck type razor, the blade edge may extend in a direction corresponding to a right-left direction, and the fulcrum portion of the connection unit and the fulcrum portion of the blade assembly may be arranged downward from the blade edge in an up-down direction that is orthogonal to the right-left direction.

With this configuration, the blade assembly is easily moved by a force applied to the blade assembly and the blade body upward from the fulcrum portions.

In the pivotal neck type razor, the connection unit may include a projection located at the rear side of the blade assembly, the projection may project toward the blade assembly and include a free end, and the fulcrum portion of the connection unit may be formed on the free end.

With this configuration, the fulcrum portions are easily formed.

In the pivotal neck type razor, the blade assembly may move in a movement direction along an arc to form an arcuate path between the neutral position and the movement position.

With this configuration, the blade assembly is easily moved around the fulcrum portions.

In the pivotal neck type razor, the fulcrum portion of the connection unit may be arcuate in correspondence with the movement direction.

With this configuration, where the fulcrum portion of the connection unit is in abutment with the fulcrum portion of the blade assembly varies as the blade assembly is moved so that contact resistance between the fulcrum portions is reduced. Smooth movement of the blade assembly improves the feel on the skin surface when the pivotal neck type razor is used.

In the pivotal neck type razor, each of the flexible portions may include an inner end that is adjacent to the connection unit and an outer end that is adjacent to one of the two support portions that is adjacent to the flexible portion, a space between the two outer ends of the two flexible portions may define a planned space, and the fulcrum portion of the connection unit and the fulcrum portion of the blade assembly may be arranged inside the planned space.

With this configuration, the fulcrum portions are arranged inside the planned space between the two outer ends of the two flexible portions. This stabilizes the movement of the flexible portions when the blade assembly is moved against an urging force of the flexible portions, thereby allowing for smooth movement of the blade assembly.

In the pivotal neck type razor, the blade assembly may be movable in a plurality of movement directions, the at least one movement position may be a plurality of movement positions, and the blade assembly may move in at least one of the movement directions between the neutral position and each of the movement positions.

With this configuration, the blade assembly moves in the movement directions so that the shaving of the pivotal neck type razor is improved. For example, when the fulcrum portion of the connection unit and the fulcrum portion of the blade assembly are in abutment with each other at the movement positions of the blade assembly, the blade assembly is supported by the abutment of the fulcrum portions at the movement positions. This stabilizes the movement of the blade assembly relative to the connection unit at the movement positions.

In the pivotal neck type razor, the blade edge may extend in a direction corresponding to a right-left direction, the right-left direction may be orthogonal to a direction that is a front-rear direction, the right-left direction and the front-rear direction may be both orthogonal to a direction that is an up-down direction, the front-rear direction and the up-down direction may define a vertical plane, the right-left direction and the front-rear direction may define a horizontal plane, the movement positions may include a first movement position and a second movement position, the blade assembly may move in a movement direction along an arc to form an arcuate path on the vertical plane between the neutral position and the first movement position, and the blade assembly may move in a movement direction along an arc to form an arcuate path on the horizontal plane between the neutral position and the second movement position.

With this configuration, the blade assembly moves in the movement directions to form an arcuate path on the vertical plane and on the horizontal plane so that the shaving of the pivotal neck type razor is improved.

In the pivotal neck type razor, each of the flexible portions may include an inner end that is adjacent to the connection unit, an outer end that is adjacent to one of the two support portions that is adjacent to the flexible portion, and an inclined portion located between the inner end and the outer end, a space between the two outer ends of the two flexible portions may define a planned space, and the inclined portion of each of the flexible portions may be inclined to approach the planned space from the inner end of the flexible portion toward the outer end of the flexible portion.

With this configuration, the inclined portion prolongs the length between the inner end and the outer end of the flexible portion so that the flexible portion is easily bent.

In the pivotal neck type razor, the distance between the two flexible portions gradually may increase from the inner ends to the outer ends.

With this configuration, the inclined portion is easily formed for the two flexible portions.

In the pivotal neck type razor, each of the support portions of the elastic support body may include a continuous portion molded integrally with one of the two flexible portions that is adjacent to the support portion, and the connection unit may include a continuous portion molded integrally with the two flexible portions.

With this configuration, the two flexible portions are easily attached to the two support portions of the elastic support body and the connection unit of the razor head at the continuous portions.

In the pivotal neck type razor, the connection unit of the razor head and the top end of the holder may each include a coupling portion that couples the connection unit to the top end in a removable manner.

With this configuration, the razor head is attached in a removable manner to the holder at the coupling portion.

The present invention simplifies a support structure of a pivotal neck type razor that supports a razor head on a top end of a holder so that the razor head moves relative to the top end of the holder from a neutral position against an elastic force.

DETAILED DESCRIPTION OF THE PREFERRED EMBODIMENTS

A pivotal neck type razor according to one embodiment of the present invention will now be described with reference to the drawings.

Figure 1C:
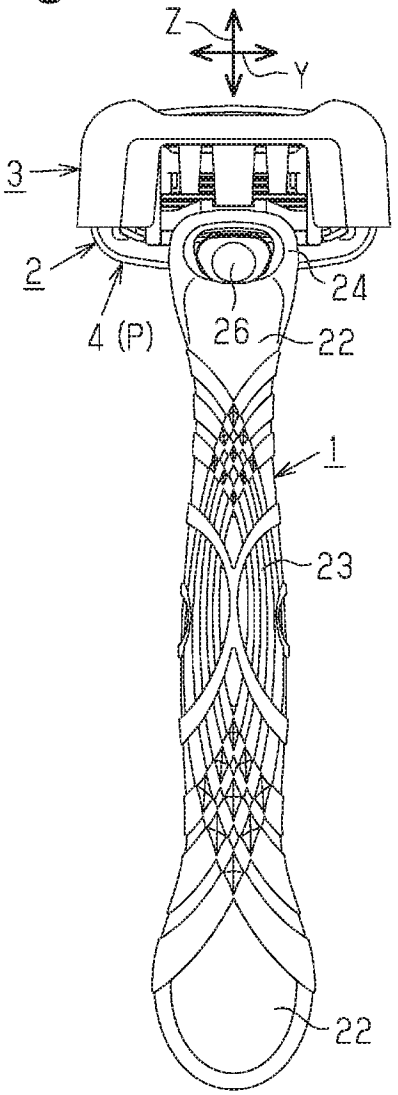
FIG. 1C is a rear view of the pivotal neck type razor shown in FIG. 1A.
Figure 1B:
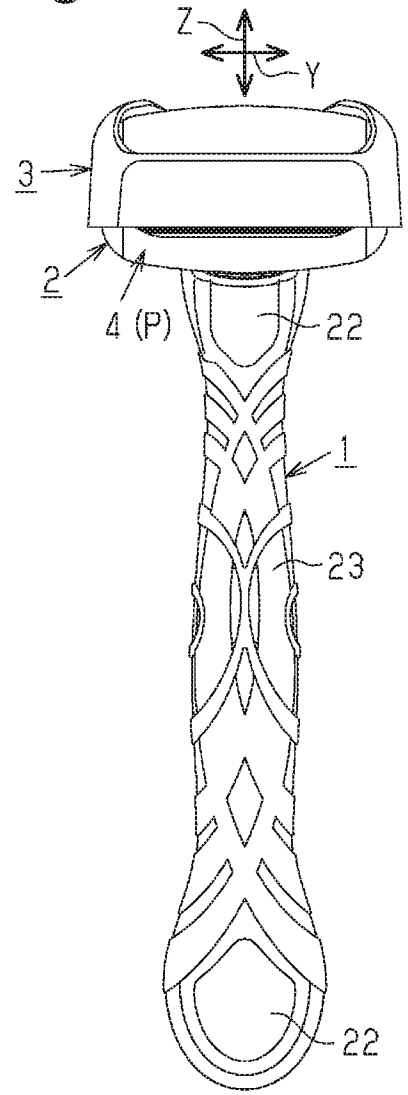
FIG. 1B is a front view of the pivotal neck type razor shown in FIG. 1A.
Figure 1A:
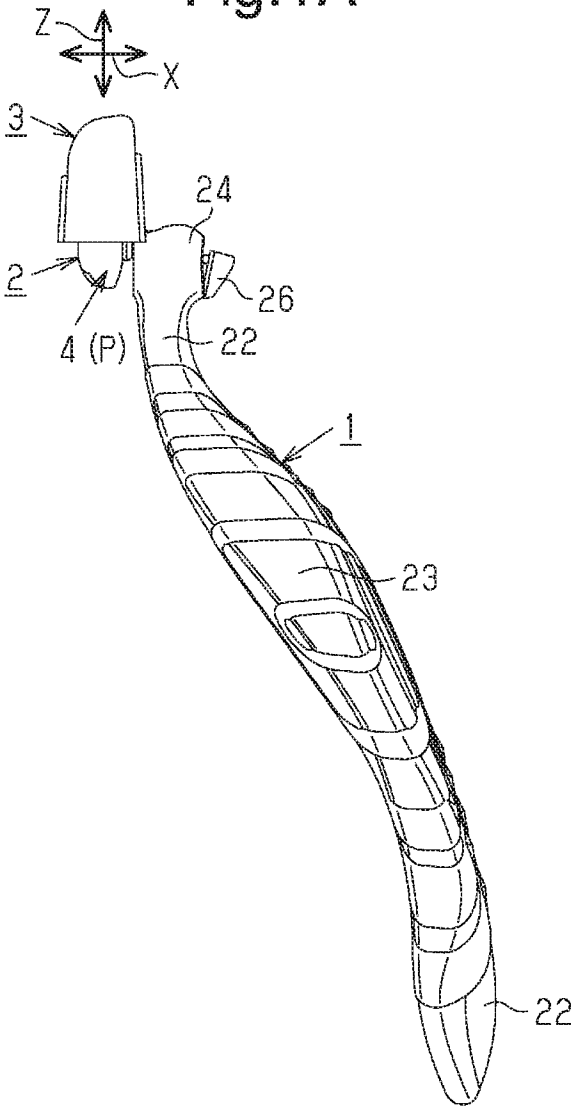
FIG. 1A is a side view entirely showing a pivotal neck type razor in which a cap is covering a razor head attached to a holder.
Figure 2A:
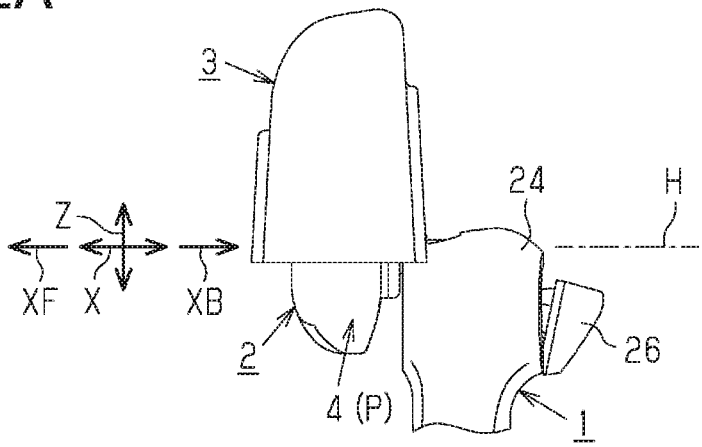
FIG. 2A is a partially enlarged side view of FIG. 1A.
Figure 2B:
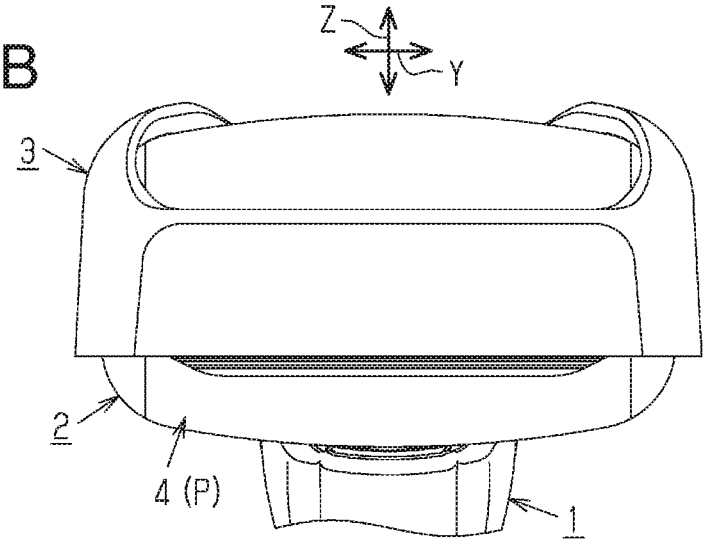
FIG. 2B is a partially enlarged front view of FIG. 1B.
Figure 2C:
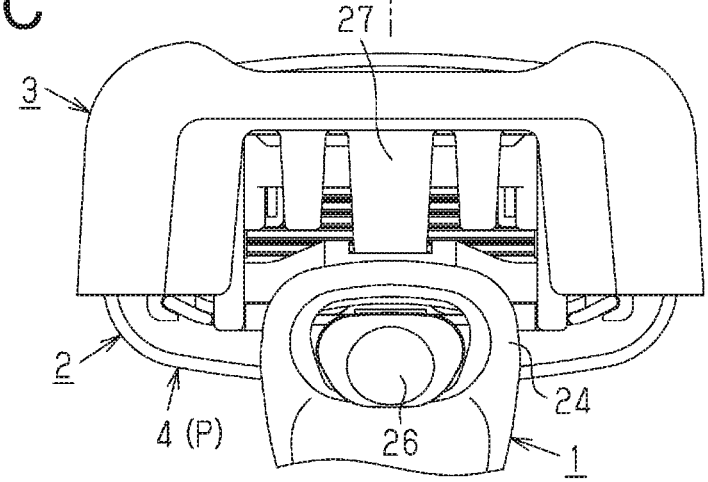
FIG. 2C is a partially enlarged rear view of FIG. 1C.
Figure 3A:
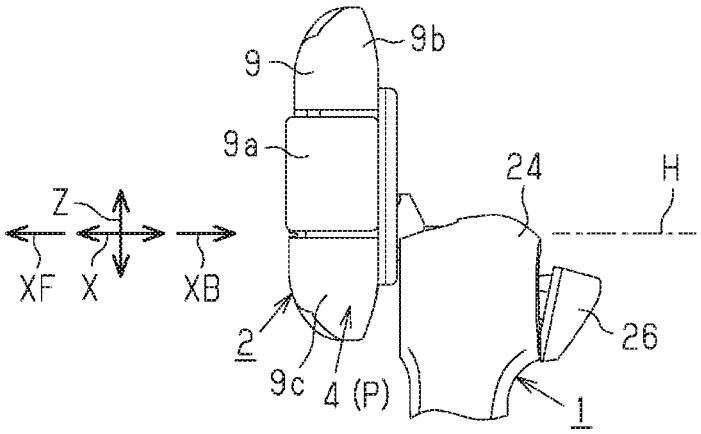
FIG. 3A is a partially enlarged side view showing the razor head without the cap.
Figure 3B:
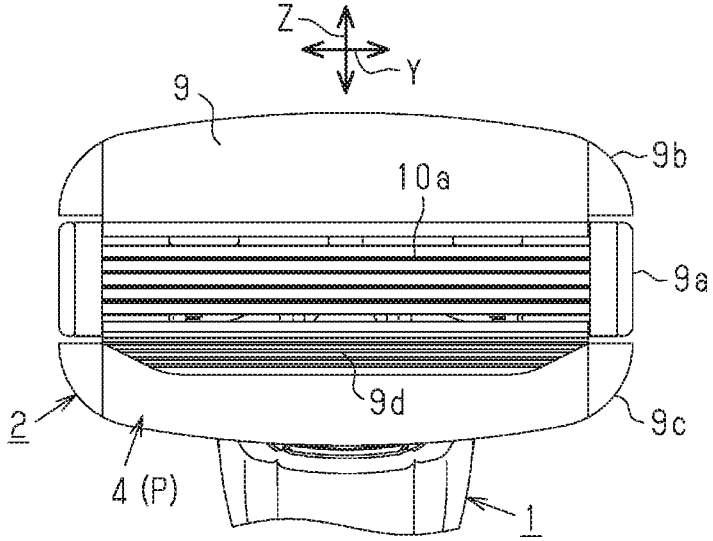
FIG. 3B is a partially enlarged front view showing the razor head without the cap.
Figure 3C:
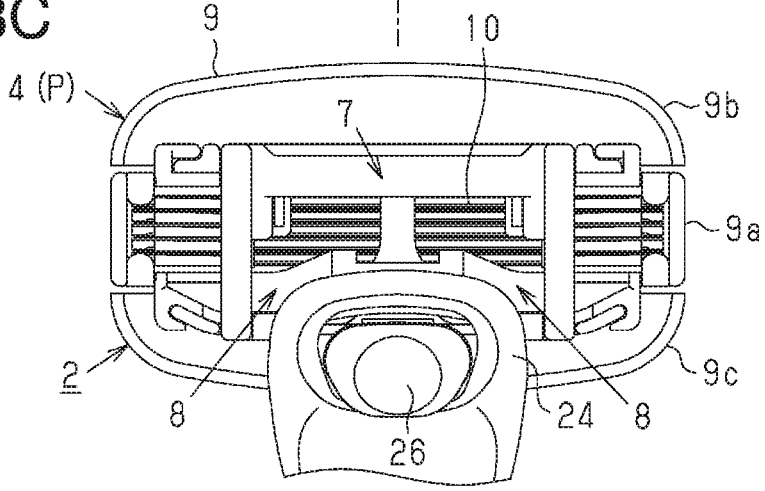
FIG. 3C is a partially enlarged rear view showing the razor head without the cap.

The pivotal neck type razor shown in FIGS. 1A to 1C includes a holder 1, a razor head 2, and a cap 3. The razor head 2 includes a blade assembly 4, an elastic support body 5, and a connection unit 6. The elastic support body 5 includes a support portion 7 and a flexible portion 8.

As shown in FIGS. 3A to 3C, 6A, 6B, 7A, and 7B, the blade assembly 4 of the razor head 2 includes a frame 9 formed by an intermediate portion 9*a*, an upper portion 9*b*, and a lower portion 9*c*. The upper portion 9*b* and the lower portion 9*c* are attached to the intermediate portion 9*a* in a non-removable manner. Blade bodies 10, each having a blade edge 10*a*, are coupled to the intermediate portion 9*a*. The blade bodies 10 are arranged in up-down direction Z. The blade edge 10*a* of each blade body 10 is exposed to the outside at the front side of the intermediate portion 9*a* and extends in right-left direction Y. As shown in FIG. 5B, an uneven mounting base 11 is arranged at the rear side of the intermediate portion 9*a* inside the frame 9. A restriction 12 having the form of a plate is arranged downward from the mounting base 11. The restriction 12 is located at a central portion of the blade assembly 4 in right-left direction Y. The restriction 12 projects in rearward direction XB from the rear surface of the intermediate portion 9*a*. A fulcrum groove 13 (fulcrum portion) extends in right-left direction Y between the restriction 12 and the mounting base 11. Shaving aids are attached to the front surfaces of the upper portion 9*b* and the lower portion 9*c* of the frame 9. Further, soft plastic fins 9*d* are arranged on the front surface of the lower portion 9*c* to grab a beard.

Figure 4A:
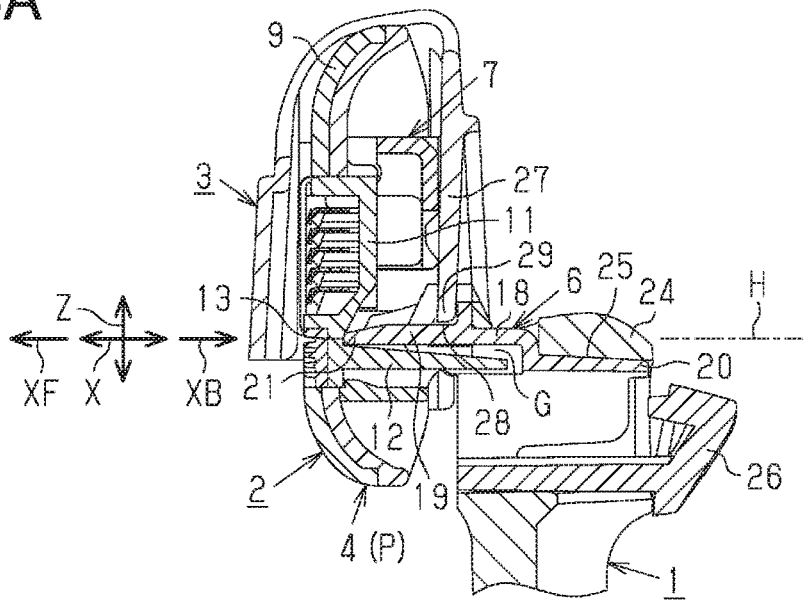
FIG. 4A is a partially enlarged cross-sectional side view showing the razor head and a top end of the holder.
Figure 4B:
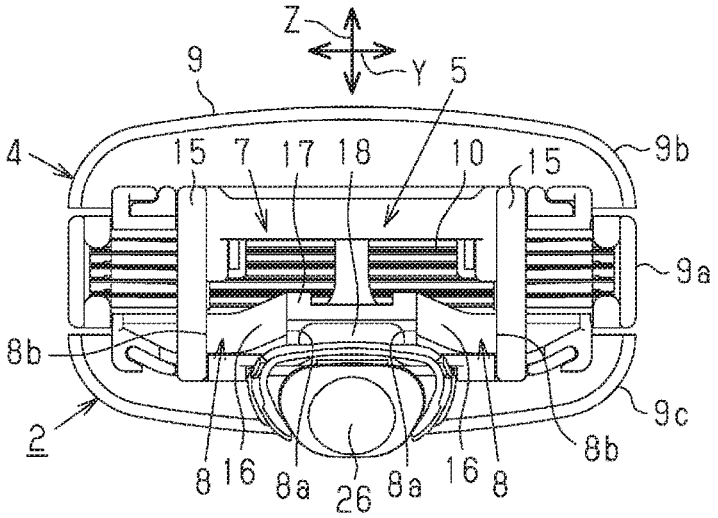
FIG. 4B is a partially enlarged rear view showing the razor head removed from the top end of the holder.
Figure 5A:
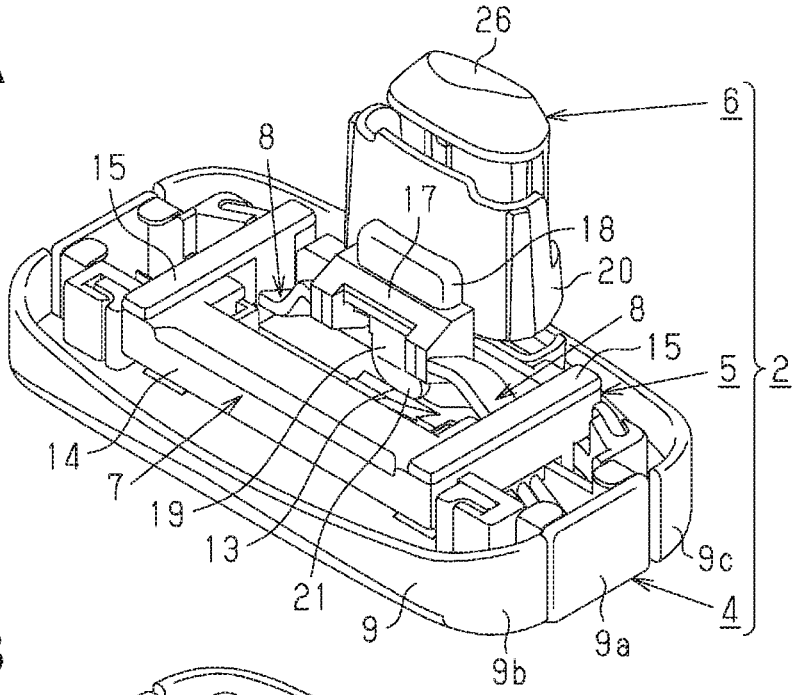
FIG. 5A is a rear perspective view showing the razor head removed from the top end of the holder, with a blade assembly, an elastic support body, and a connection unit coupled to one another.
Figure 5B:
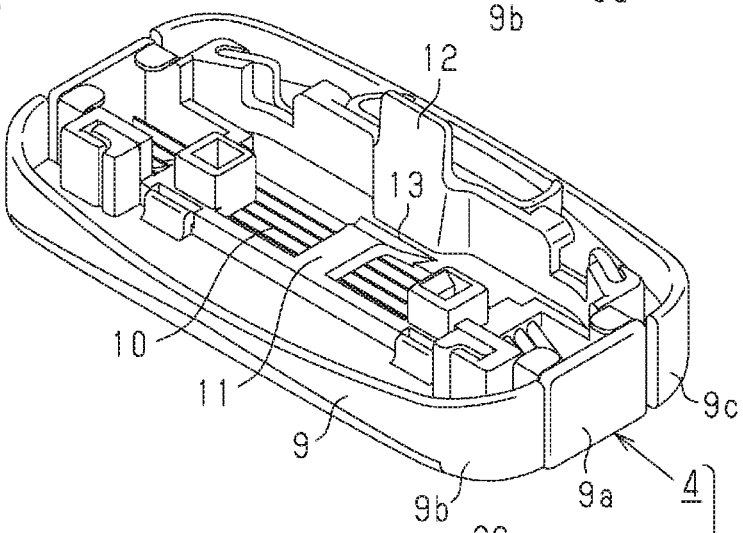
FIG. 5B is a rear perspective view showing the blade assembly prior to coupling.
Figure 5C:
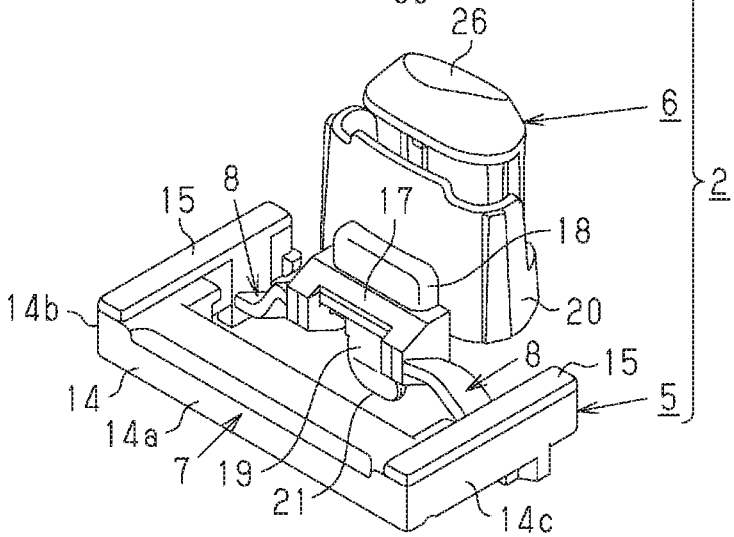
FIG. 5C is a rear perspective view showing the elastic support body and the connection unit prior to coupling.
Figure 6B:
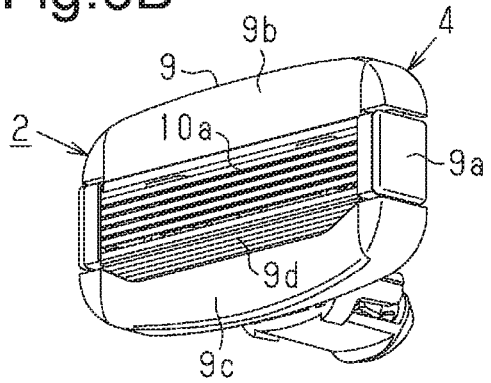
FIG. 6B is a front perspective view showing the blade assembly in which the upper portion and the lower portion are coupled to the intermediate portion that includes the blade bodies.
Figure 6A:
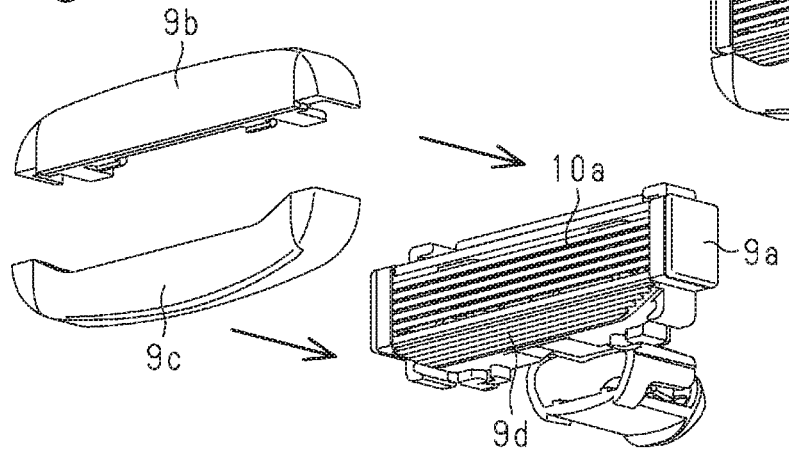
FIG. 6A is a front perspective view showing the blade assembly in which an upper portion and a lower portion are separated from an intermediate portion that includes blade bodies.
Figure 7A:
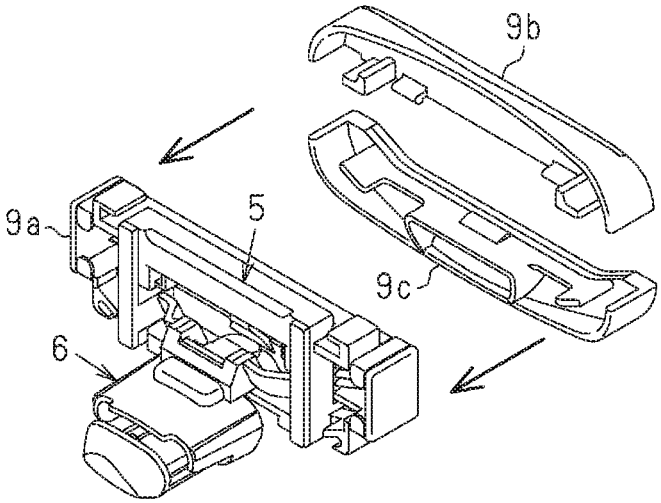
FIG. 7A is a rear perspective view showing the blade assembly in which the upper portion and the lower portion are separated from the intermediate portion that includes the blade bodies.
Figure 7B:
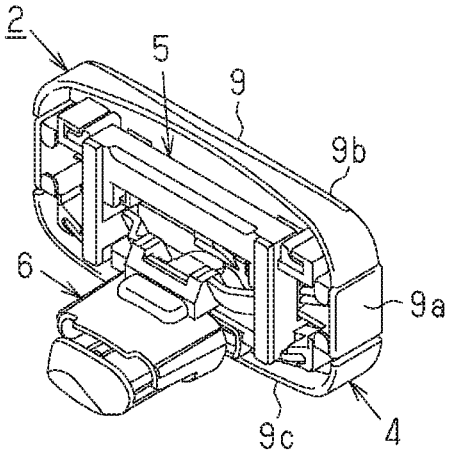
FIG. 7B is a rear perspective view showing the blade assembly in which the upper portion and the lower portion are coupled to the intermediate portion that includes the blade bodies.
Figure 9A:
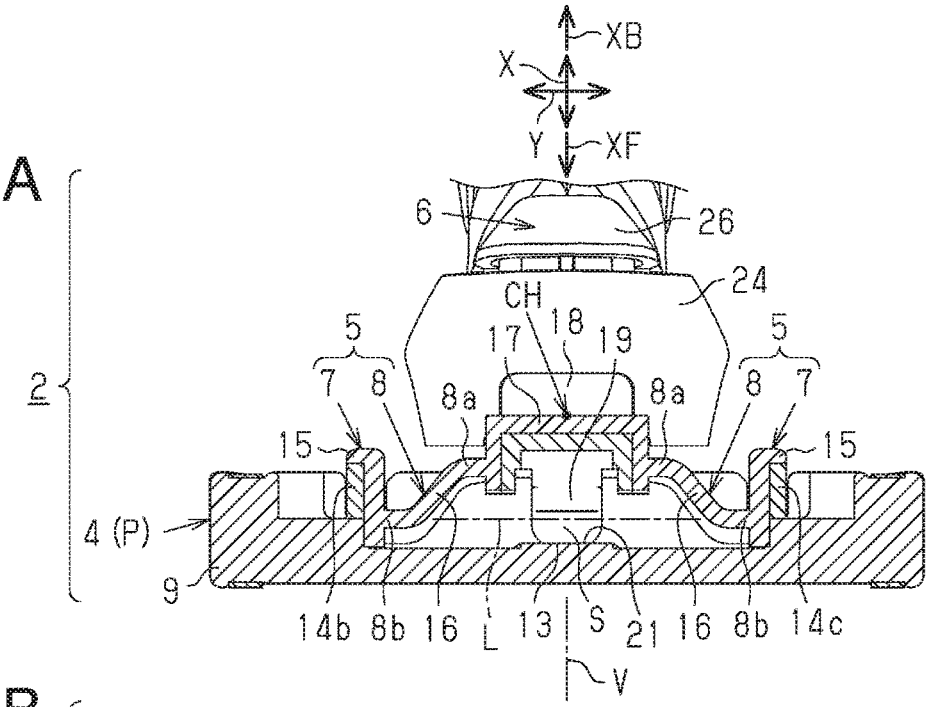
FIG. 9A is a partially enlarged cross-sectional plan view showing the razor head when the blade assembly is at the neutral position.
Figure 9B:
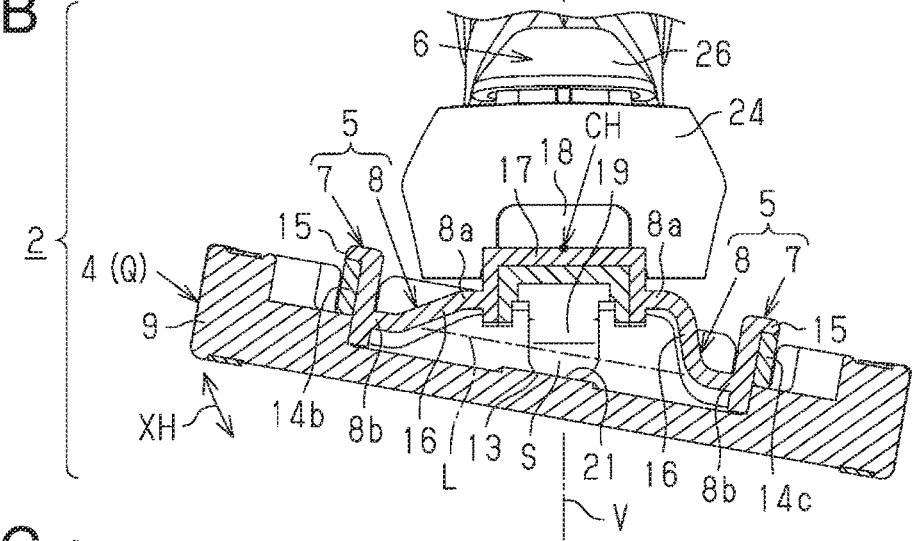
FIG. 9B is a partially enlarged cross-sectional plan view showing the razor head when the blade assembly is at a movement position.
Figure 9C:
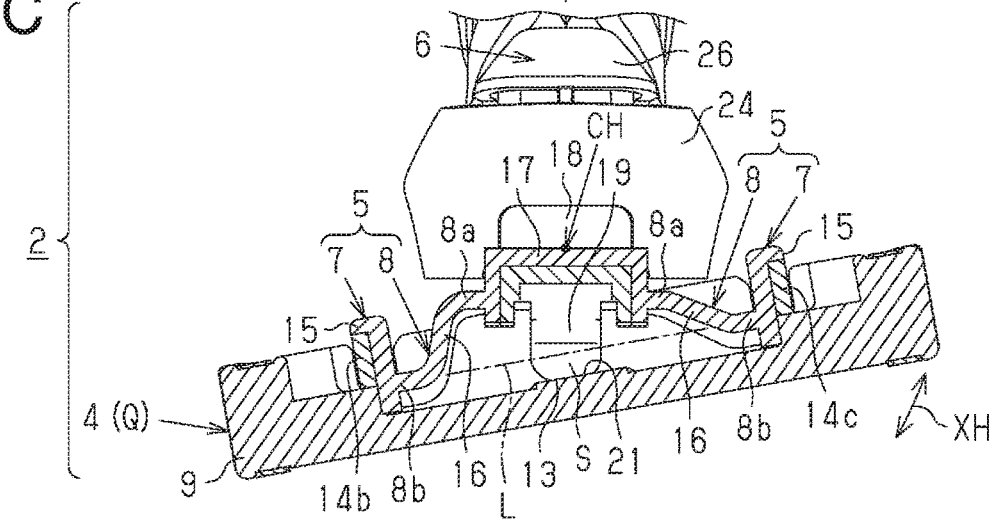
FIG. 9C is a partially enlarged cross-sectional plan view showing the razor head when the blade assembly is at a movement position.

As shown in FIG. 5C, the support portion 7 of the elastic support body 5 of the razor head 2 includes a mount 14 formed to be substantially U-shaped by an upper portion 14*a*, a left portion 14*b* (support portion), and a right portion 14*c* (support portion). The connection unit 6 of the razor head 2 is arranged between the left portion 14*b* and the right portion 14*c*. The flexible portion 8, which has the form of a plate with a rectangular cross section, is arranged between the connection unit 6 and the left portion 14*b* and between the connection unit 6 and the right portion 14*c*. Continuous portions 15 (support portion) that are integrally molded with the flexible portion 8 are arranged on the left portion 14*b* and the right portion 14*c*. The mount 14 of the support portion 7 is attached in a non-removable manner to the mounting base 11 of the blade assembly 4. As shown in FIG. 4B, the right and left flexible portions 8 each include an inner end 8*a*, which is adjacent to the connection unit 6, and an outer end 8*b*, which is opposite to the inner end 8*a*. Specifically, the outer end 8*b* of the left flexible portion 8 is adjacent to the left portion 14*b* of the support portion 7. The outer end 8*b* of the right flexible portion 8 is adjacent to the right portion 14*c* of the support portion 7. As shown in FIGS. 9A to 9C, the space between the two outer ends 8*b* of the right and left flexible portions 8 defines planned space S. Specifically, planned space S is the space lying along planned line L that connects the outer ends 8*b* of the right and left flexible portions 8 or a hollow space surrounding planned line L. In other words, planned space S is a hollow space including lines extended from the outer edges of the outer ends 8*b* that have a predetermined cross section such as a rectangular cross section. The flexible portions 8 each include an inclined portion 16 that is inclined toward planned space S from the inner end 8*a* to the outer end 8*b* of the flexible portion 8. The distance between the inclined portions 16 of the right and left flexible portions 8 gradually increases from the inner ends 8*a* to the outer ends 8*b*. The inclined portions 16 are inclined relative to planned space S in front-rear direction X and up-down direction Z.

As shown in FIGS. 5A and 5C, the connection unit 6 of the razor head 2 includes a main body 18, a flat tongue 19 (projection) and a coupling tube 20 (coupling portion). The main body 18 includes a continuous portion 17 integrally molded with the right and left flexible portions 8. As viewed in FIG. 4A, the main body 18 is arranged upward from the restriction 12 of the blade assembly 4 facing the restriction 12. The tongue 19 extends in frontward direction XF from the main body 18. That is, the tongue 19 (projection) is arranged at the rear side of the blade assembly 4 and projects toward the blade assembly 4. The coupling tube 20 extends in rearward direction XB from the main body 18. The dimension of the tongue 19 in right-left direction Y, which is parallel to a direction in which the blade edges 10*a* of the blade bodies 10 extend, corresponds to the width of the tongue 19. The dimension of the tongue 19 in front-rear direction X, which is orthogonal to right-left direction Y, corresponds to the length of the tongue 19. The dimension of the tongue 19 in up-down direction Z, which is orthogonal to right-left direction Y and front-rear direction X, corresponds to the thickness of the tongue 19. The thickness of the tongue 19 is less than the width and the length of the tongue 19. The width of the tongue 19 is less than the length of the tongue 19. A free end of the tongue 19 includes a fulcrum edge 21 (fulcrum portion) extending in right-left direction Y and abutting the fulcrum groove 13 of the blade assembly 4. The dimension between the upper surface and the lower surface of the fulcrum edge 21 corresponds to the thickness of the fulcrum edge 21. The upper surface of the fulcrum edge 21 is inclined so that the thickness of the fulcrum edge 21 is reduced toward the free end. The fulcrum groove 13 of the blade assembly 4 and the fulcrum edge 21 of the tongue 19 are arranged downward from the blade edges 10*a* of the blade bodies 10 inside planned space S. The fulcrum edge 21 and the fulcrum groove 13 are in abutment with each other so that the blade assembly 4 is supported by the support portion 7 of the elastic support body 5.

Figure 8A:
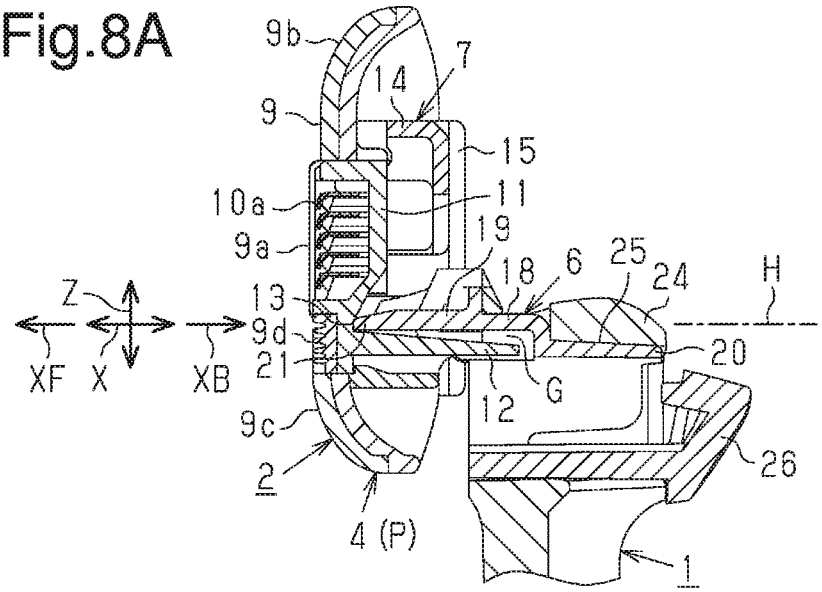
FIG. 8A is a partially enlarged cross-sectional side view showing the razor head when the blade assembly is in a neutral position.
Figure 8B:
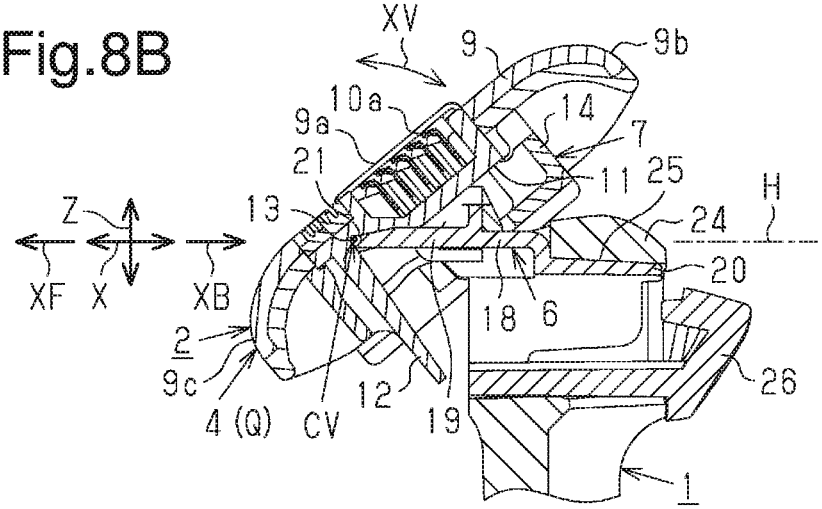
FIG. 8B is a partially enlarged cross-sectional side view showing the razor head when the blade assembly is at a movement position.
Figure 8C:
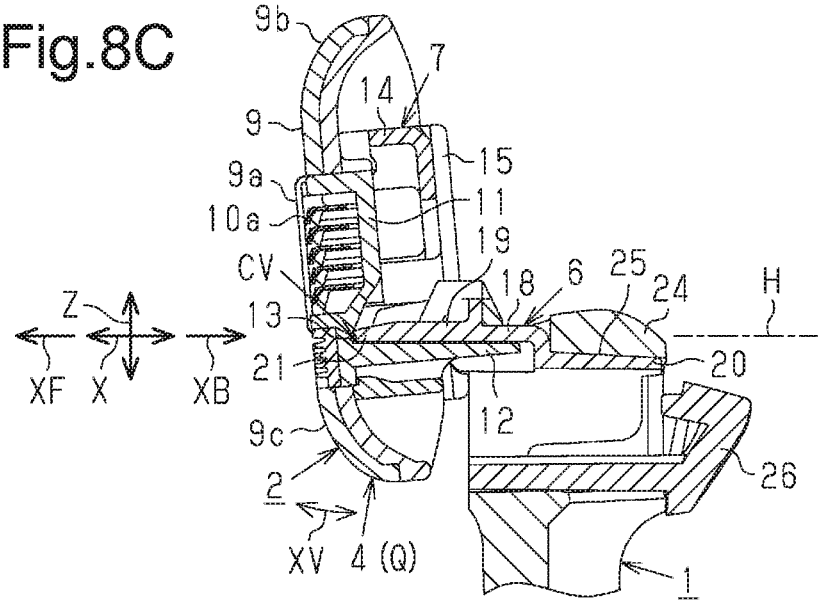
FIG. 8C is a partially enlarged cross-sectional side view showing the razor head when the blade assembly is at a movement position.

The direction in which the blade edges 10*a* of the blade bodies 10 extend corresponds to right-left direction Y. Front-rear direction X is orthogonal to right-left direction Y. Up-down direction Z is orthogonal to right-left direction Y and front-rear direction X. As shown in FIGS. 8A to 8C, deformation of the flexible portions 8 allows the blade assembly 4 to move along an arcuate path from neutral position P in front-rear direction X on vertical plane V that is set in front-rear direction X and up-down direction Z. Specifically, when the direction in which the blade assembly 4 is moved is referred to as movement direction XV, the blade assembly 4 may be moved along an arc in movement direction XV so as to form an arcuate path on vertical plane V. As shown in FIGS. 8A to 8C, deformation of the flexible portions 8 allows the blade assembly 4 to move in movement direction XV to movement position Q. Further, as shown in FIGS. 9A to 9C, deformation of the flexible portions 8 allows the blade assembly 4 to move along an arcuate path in front-rear direction X from neutral position P on horizontal plane H that is set in right-left direction Y and front-rear direction X. Specifically, when the direction in which the blade assembly 4 is moved is referred to as movement direction XH, the blade assembly 4 may be moved along an arc in movement direction XH so as to form an arcuate path on horizontal plane H. As shown in FIGS. 9A to 9C, deformation of the flexible portions 8 allows the blade assembly 4 to move in movement direction XH to movement position Q. The fulcrum groove 13 of the blade assembly 4 and the fulcrum edge 21 of the tongue 19 are shaped to be arcuate in correspondence with movement direction XV. The fulcrum edge 21 of the tongue 19 is shaped to be arcuate in correspondence with movement direction XH.

In the razor head 2, the support portion 7 of the elastic support body 5 and the connection unit 6, excluding the continuous portions 15, 17, are simultaneously molded in the same mold. Then, the flexible portions 8 are molded together with the continuous portions 15, 17 so that the continuous portions 15, 17 integrally connect the support portion 7 and the connection unit 6

Figure 4C:
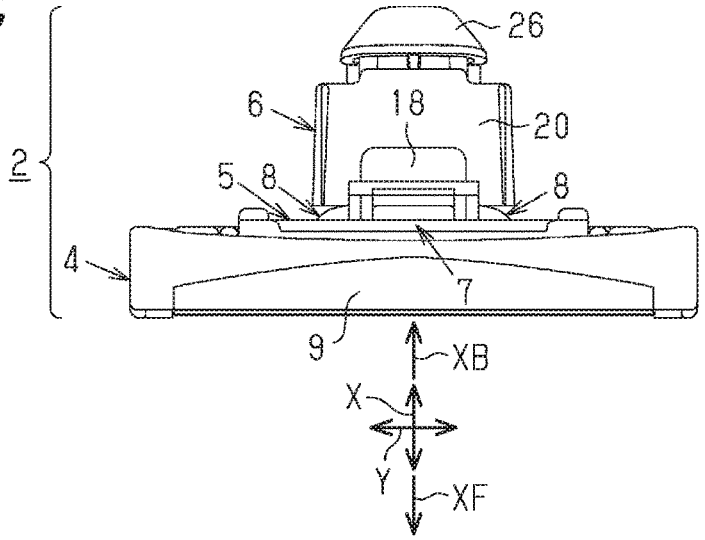
FIG. 4C is a partially enlarged plan view showing the razor head removed from the top end of the holder.

As shown in FIGS. 1A to 1C, the holder 1 includes a main body 22 elongated in up-down direction Z, a handle 23 arranged on the main body 22, and a top end 24 arranged at the upper end of the main body 22. The top end 24 includes a coupling hole 25 (coupling portion) that extends through the top end 24 in front-rear direction X. The coupling tube 20 of the connection unit 6 includes an elastic engagement portion 26 that extends in rearward direction XB (refer to FIG. 4C). The coupling tube 20 is inserted into and attached in a removable manner to the coupling hole 25 through engagement of the elastic engagement portion 26. In the inserted and attached state, the top end 24 and the connection unit 6 are integrally continuous with each other. When the elastic engagement portion 26 is disengaged and the coupling tube 20 is removed from the coupling hole 25, the top end 24 and the connection unit 6 are separated from each other.

As shown in FIGS. 1A to 2C, the cap 3 covers the blade assembly 4 of the razor head 2 in a removable manner from above in up-down direction Z. As shown in FIG. 4A, the cap 3 includes a back plate 27 that faces the rear side of the blade assembly 4. The main body 18 of the connection unit 6 of the razor head 2 includes a stopper step 28 (stopper). The lower end of the back plate 27 defines a stopper edge 29 (stopper). The stopper edge 29 of the cap 3 is engaged with the stopper step 28 of the razor head 2. The cap may be configured to cover the blade assembly 4 of the razor head 2 in a removable manner from below in up-down direction Z.

A main part of the blade assembly 4, the mount 14 of the support portion 7 of the elastic support body 5, the connection unit 6, the main body 22 of the holder 1, and the cap 3 are made of a hard plastic such as ABS or polypropylene. Further, the continuous portions 15 of the support portion 7 of the elastic support body 5, the flexible portions 8 of the elastic support body 5, the continuous portion 17 of the connection unit 6, and the handle 23 of the holder 1 are made of a soft plastic such as polyester elastomer or styrene elastomer. Elastomer for molding the flexible portions 8 may be a material having a hardness range from Shore A40 to Shore D70. For example, elastomer for molding the flexible portions 8 may be a material having a hardness of Shore A90.

The use of the pivotal neck type razor will now be described.

As shown in FIGS. 8A and 9A, at neutral position P of the pivotal neck type razor, the right and left flexible portions 8 are stationary when the fulcrum groove 13 of the blade assembly 4 and the fulcrum edge 21 of the tongue 19 are in abutment with each other. At neutral position P, the razor head 2 extends in up-down direction Z and right-left direction Y and is stationary. As shown in FIG. 8A, slight gap G is formed between the restriction 12 of the blade assembly 4 of the razor head 2 and both of the main body 18 and tongue 19 of the connection unit 6 of the razor head 2.

When the upper portion of the blade assembly 4 located at neutral position P is pushed in rearward direction XB, the right and left flexible portions 8 are deformed while the fulcrum groove 13 and the fulcrum edge 21 abut each other at abutment portion CV as shown in FIG. 8B. As a result, the upper portion of the blade assembly 4 is pivoted in rearward direction XB about abutment portion CV along vertical plane V together with the support portion 7 of the elastic support body 5. The pivoting inclines the blade assembly 4 together with the support portion 7 of the elastic support body 5, and the blade assembly 4 stops at movement position Q (first movement position). Gap G increases as the restriction 12 of the blade assembly 4 moves downward from the main body 18 and the tongue 19 of the connection unit 6. The blade assembly 4 can be pivoted until the support portion 7 of the elastic support body 5 abuts the connection unit 6.

When the lower portion of the blade assembly 4 located at neutral position P is pushed in rearward direction XB, the right and left flexible portions 8 are deformed while the fulcrum groove 13 and the fulcrum edge 21 abut each other at abutment portion CV as shown in FIG. 8C. As a result, the lower portion of the blade assembly 4 is pivoted in rearward direction XB about abutment portion CV along vertical plane V together with the support portion 7 of the elastic support body 5. The pivoting inclines the blade assembly 4 together with the support portion 7 of the elastic support body 5, and the blade assembly 4 stops at movement position Q (first movement position). The blade assembly 4 can be pivoted inside gap G until the restriction 12 abuts the connection unit 6. That is, movement direction XV corresponds to a direction that extends along an arc about abutment portion CV.

When the left portion of the blade assembly 4 located at neutral position P is pushed in rearward direction XB, the right and left flexible portions 8 are deformed while the fulcrum groove 13 and the fulcrum edge 21 abut each other as shown in FIG. 9B. As a result, the left portion of the blade assembly 4 is pivoted in rearward direction XB about hypothetical position CH, which is located rearward from the fulcrum edge 21, along horizontal plane H together with the support portion 7 of the elastic support body 5. The pivoting inclines the blade assembly 4 together with the support portion 7 of the elastic support body 5, and the blade assembly 4 stops at movement position Q (second movement position). The blade assembly 4 can be pivoted until the blade assembly 4 abuts the connection unit 6.

When the right portion of the blade assembly 4 located at neutral position P is pushed in rearward direction XB, the right and left flexible portions 8 are deformed while the fulcrum groove 13 and the fulcrum edge 21 abut each other as shown in FIG. 9C. As a result, the right portion of the blade assembly 4 is pivoted in rearward direction XB about hypothetical position CH along horizontal plane H together with the support portion 7 of the elastic support body 5. The pivoting inclines the blade assembly 4 together with the support portion 7 of the elastic support body 5, and the blade assembly 4 stops at movement position Q (second movement position). The blade assembly 4 can be pivoted until the blade assembly 4 abuts the connection unit 6. That is, movement direction XH corresponds to a direction that extends along an arc about hypothetical position CH.

Although not illustrated, pivoting may be performed by combining pivoting of the blade assembly 4 along vertical plane V (refer to FIGS. 8B and 8C) and pivoting of the blade assembly 4 along horizontal plane H (refer to FIGS. 9B and 9C).

The present embodiment has the following advantages.

(1) The blade assembly 4 of the razor head 2 is supported by the flexible portions 8. This simplifies the support structure that pivotally supports the blade assembly 4 against an urging force of the flexible portions 8.

(2) The flexible portions 8 are arranged on the rear side of the blade assembly 4. The flexible portions 8 can easily be arranged at locations relatively close to the blade bodies 10. This allows for smooth movement of the blade assembly 4 on the skin surface and improves the feel on the skin surface.

(3) When the blade assembly 4 of the pivotal neck type razor during usage is pivoted against an urging force of the flexible portions 8, the blade assembly 4 is supported by the fulcrum portions (support groove 13 and support edge 21). This stabilizes the movement of the blade assembly 4.

The above embodiment may be modified as follows.

In the embodiment, the connection unit 6 and the blade assembly 4 of the razor head 2 include the fulcrum portions (fulcrum groove 13, fulcrum edge 21) that movably support the blade assembly 4 relative to the connection unit 6. Instead, the fulcrum portions may be omitted and the right and left flexible portions 8 may support the blade assembly 4 and the support portion 7 of the elastic support body 5. Further, instead of a single fulcrum portion, plural fulcrum portions may be arranged.

In the embodiment, the fulcrum portions (fulcrum edge 21, fulcrum groove 13) are arranged inside planned space S. However, the fulcrum portions may be arranged outside planned space S.

In the embodiment, the fulcrum edge 21 of the connection unit 6 and the fulcrum groove 13 of the blade assembly 4 are in abutment with each other at neutral position P and movement position Q. In other words, the blade assembly 4 is supported by the connection unit 6 by the abutment between the fulcrum edge 21 and fulcrum groove 13 at neutral position P and movement position Q. However, the fulcrum edge 21 of the connection unit 6 and the fulcrum groove 13 of the blade assembly 4 need only to abut each other in at least one of neutral position P and movement position Q. In other words, the blade assembly 4 need only be supported by the connection unit 6 through abutment of the fulcrum edge 21 and fulcrum groove 13 in at least one of neutral position P and movement position Q. The fulcrum portions (fulcrum edge 21, fulcrum groove 13) may be separated at neutral position P and the fulcrum portions may be brought into abutment during movement from neutral position P to movement position Q.

The embodiment allows for pivoting of the blade assembly 4 along vertical plane V, pivoting of the blade assembly 4 on horizontal plane H, and a combination of these pivotings. However, modifications may be made so that only one of these pivotings is performed.

The flat tongue 19 may be deformable in the thickness direction (up-down direction Z).

In the embodiment, the flat tongue 19 is used. However, the tongue 19 may be replaced with a rod-shaped projection. In this case, the projection may include a semispherical fulcrum portion at the distal end.

In the embodiment, the connection unit 6 of the razor head 2 is attached in a removable manner to the top end 24 of the holder 1 at the coupling portions (coupling tube 20, coupling hole 25). Instead, the coupling portions may be omitted and the razor head 2 may be integrated with the holder 1. The connection unit 6 and the top end 24 may have a coupling structure reversing the projection-recess relationship that allows for attachment and removal. Further, other coupling structures may be used.

In the embodiment, the flexible portion 8 has the form of a plate with a rectangular cross section. Instead, the flexible portion may have a circular, triangular, or T-shaped cross section.

In the embodiment, the flexible portions 8 including the inclined portions 16 are arranged to substantially extend in right-left direction Y. Instead, the flexible portions 8 may be arranged to substantially extend in up-down direction Z.

In the embodiment, the flexible portions 8 are arranged between the support portion 7 and the connection unit 6 at two sides in right-left direction Y. Instead, one or more than two flexible portions 8 may be arranged between the support portion 7 and the connection unit 6.

In the embodiment, the flexible portions 8, the continuous portions 15 of the support portion 7, and the continuous portion 17 of the connection unit 6 are made of soft plastic. Instead, the flexible portions 8, the continuous portion 15, and the continuous portion 17 may be formed as thin plates or thin hinges without using soft plastic so that the portions can be deformed.

In the embodiment, the blade edges 10*a* of the blade bodies 10 of the razor head 2 extend in right-left direction Y and the holder 1 extends in up-down direction Z. Instead, the holder 1 may be arranged to extend in a direction other than up-down direction Z.

In the embodiment, the shaving aids are attached to the front surfaces of the upper portion 9*b* and the lower portion 9*c* of the frame 9. Instead, the shaving aid may be applied to any one, two, or three of the intermediate portion 9*a*, the upper portion 9*b*, and the lower portion 9*c* of the frame 9.

The shaving aid attached to the front surface of the upper portion 9*b* of the frame 9 may contain the same component as the shaving aid attached to the front surface of the lower portion 9*c* of the frame 9. The shaving aid attached to the front surface of the upper portion 9*b* of the frame 9 may contain a different component as the shaving aid attached to the front surface of the lower portion 9*c* of the frame 9. A shaving aid containing a moisturizing component may be attached to the front surface of the upper portion 9*b*.

In the embodiment, the upper portion 9*b* and the lower portion 9*c* to which shaving aids are applied are attached to the intermediate portion 9*a* in a non-removable manner. Instead, the upper portion 9*b* and the lower portion 9*c* may be attached to the intermediate portion 9*a* in a removable manner so that the upper portion 9*b* and the lower portion 9*c* can be replaced.

DESCRIPTION OF THE REFERENCE NUMERALS

1 . . . holder, 2 . . . razor head, 4 . . . blade assembly, 5 . . . elastic support body, 6 . . . connection unit, 7 . . . support portion, 8 . . . flexible portion, 10 . . . blade body, 10*a* . . . blade edge of blade body, 13 . . . fulcrum groove (fulcrum portion), 14*b* . . . left portion (support portion) of mount, 14*c* . . . right portion (support portion) of mount, 15 . . . continuous portion (support portion) of flexible portion, 19 . . . tongue (projection), 21 . . . fulcrum edge (fulcrum portion), 24 . . . top end of holder, P . . . neutral position, Q . . . movement position (first and second movement positions), X . . . front-rear direction, Y . . . right-left direction, Z . . . up-down direction

The invention claimed is:

1. A pivotal neck razor comprising:

a holder including an end; and a razor head attached to the holder, wherein the razor head includes an elastic support body, a connection unit that is continuous with the end of the holder, and a blade assembly that includes blade bodies, the blade assembly includes a front side from which a blade edge of each of the blade bodies is exposed and a rear side that is opposite to the front side, the elastic support body is located at the rear side, the elastic support body includes a support portion that supports the blade assembly and a flexible portion located between the support portion and the connection unit, the blade assembly is urged by the flexible portion of the elastic support body to be stationary at a neutral position, and the blade assembly is movable to at least one movement position from the neutral position against an urging force of the flexible portion, wherein the connection unit and the blade assembly each include a fulcrum portion that supports the blade assembly on the connection unit, the support portion is one of two support portions that support the blade assembly, the flexible portion is one of two flexible portions, one of the two flexible portions is arranged between one of the two support portions and the connection unit, the other one of the two flexible portions is arranged between the other one of the two support portions and the connection unit, the blade edge of each of the blade bodies extends in a direction corresponding to a first-second direction, the two flexible portions are arranged at two sides of the connection unit in the first-second direction, the blade edges of the blade bodies are arranged in a third-fourth direction that is orthogonal to the first-second direction, and the fulcrum portion of the connection unit and the fulcrum portion of the blade assembly are located at a first side of the blade edges of all the blade bodies in the third-fourth direction, wherein the blade assembly moves along a first arc about the fulcrum portion of the connection unit in a vertical plane defined by a fifth-sixth direction and the third-fourth direction and along a second arc about the fulcrum portion of the connection unit in a horizontal plane defined by the first-second direction and the fifth-sixth direction, wherein the fifth-sixth direction is orthogonal to both the third-fourth direction and the first-second direction, wherein the two support portions and the connection unit are integrally molded, and the two flexible portions and the continuous portions are integrally molded, and wherein the continuous portions integrally connect the support portion and the connection unit.

2. The pivotal neck razor according to claim 1, wherein the connection unit includes a projection located at the rear side of the blade assembly, the projection projects toward the blade assembly and includes a free end, and the fulcrum portion of the connection unit is formed on the free end.

3. The pivotal neck razor according to claim 1, wherein the blade assembly moves in a movement direction along an arc to form an arcuate path between the neutral position and the movement position.

4. The pivotal neck razor according to claim 3, wherein the fulcrum portion of the connection unit is arcuate in correspondence with the movement direction.

5. The pivotal neck razor according to claim 1, wherein each of the flexible portions includes an inner end that is adjacent to the connection unit and an outer end that is adjacent to one of the two support portions that is adjacent to the flexible portion, a space between the two outer ends of the two flexible portions defines a planned space, and the fulcrum portion of the connection unit and the fulcrum portion of the blade assembly are arranged inside the planned space.

6. The pivotal neck razor according to claim 1, wherein the blade assembly is movable in a plurality of movement directions, the at least one movement position is a plurality of movement positions, and the blade assembly moves in at least one of the movement directions between the neutral position and each of the movement positions.

7. The pivotal neck razor according to claim 6, wherein the movement positions include a first movement position and a second movement position, the blade assembly moves in a movement direction along the first arc to form a first arcuate path on the vertical plane between the neutral position and the first movement position, and the blade assembly moves in a movement direction along the second arc to form a second arcuate path on the horizontal plane between the neutral position and the second movement position.

8. The pivotal neck razor according to claim 1, wherein each of the flexible portions includes an inner end that is adjacent to the connection unit, an outer end that is adjacent to one of the two support portions that is adjacent to the flexible portion, and an inclined portion located between the inner end and the outer end, a space between the two outer ends of the two flexible portions defines a planned space, and the inclined portion of each of the flexible portions is inclined to approach the planned space from the inner end of the flexible portion toward the outer end of the flexible portion.

9. The pivotal neck razor according to claim 8, wherein a distance between the two flexible portions increases from the inner ends to the outer ends.

10. The pivotal neck razor according to claim 1, wherein the connection unit of the razor head and the end of the holder each include a coupling portion that couples the connection unit to the end in a removable manner.

* * * * *